United States Patent [19]

Obrecht et al.

[11] Patent Number: 4,825,525

[45] Date of Patent: May 2, 1989

[54] CLINCHING TOOL

[76] Inventors: Robert E. Obrecht, 1718 Hamilton, Bloomfield Hills, Mich. 48013; Edward J. Waltonen, 23214 E. Ranch Hill, Southfield, Mich. 48034

[21] Appl. No.: 128,194

[22] Filed: Dec. 3, 1987

Related U.S. Application Data

[63] Continuation-in-part of Ser. No. 901,621, Aug. 29, 1986.

[51] Int. Cl.[4] ..... B23P 19/00

[52] U.S. Cl. ..... 29/243.5; 29/21.1; 29/509

[58] Field of Search ..... 29/243.5, 243.52, 21.1, 29/509, 522 R

[56] References Cited

U.S. PATENT DOCUMENTS

| | | | |
|---|---|---|---|
| 2,811,880 | 11/1957 | Williams | 29/21.1 |
| 4,208,776 | 6/1980 | Schleicher | 29/243.5 |
| 4,584,753 | 4/1986 | Eckold et al. | 29/243.5 |
| 4,658,502 | 4/1987 | Eckold et al. | 29/21.1 |
| 4,660,403 | 4/1987 | Slasinski | 72/389 |

*Primary Examiner*—Daniel C. Crane
*Attorney, Agent, or Firm*—Krass & Young

[57] ABSTRACT

A clinching tool including a punch and a die assembly. The die assembly includes a collet and a pin. The collet is formed of bar stock and includes a lower central knock out bore and an upper central pin bore coacting at their juncture to form an annular seat within the collet. A plurality of circumferentially spaced axially extending slots are formed in the annular collet wall surrounding the upper pin bore to define a plurality of cantilevered collet fingers having their free ends at the upper end of the collet. The pin has a diameter approximating the diameter of the pin bore and a length slightly less than the length of the pin bore and is fitted in the pin bore with its lower end seated on the annular shoulder between the pin bore and the knock out bore and with its upper end spaced slightly below the upper ends of the collet fingers.

4 Claims, 2 Drawing Sheets

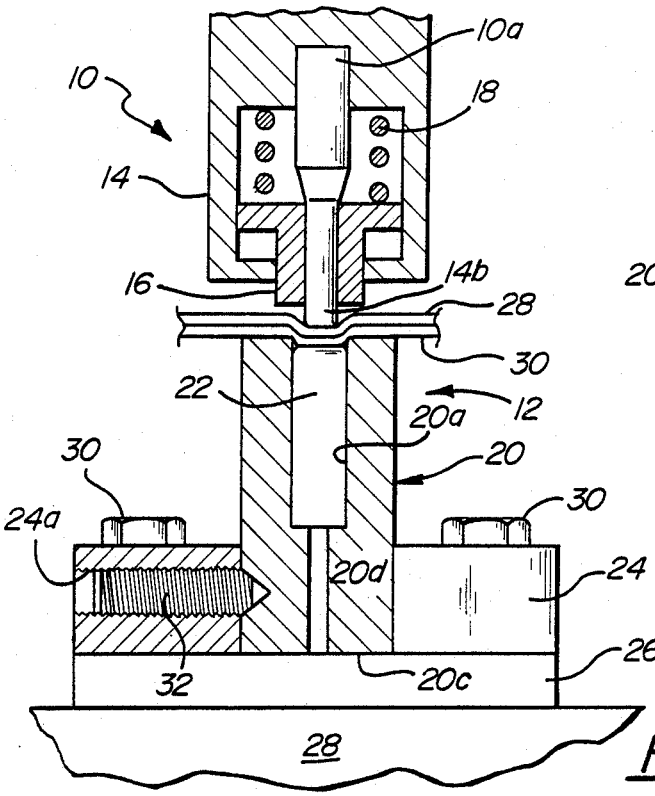
FIG. 1
FIG. 3
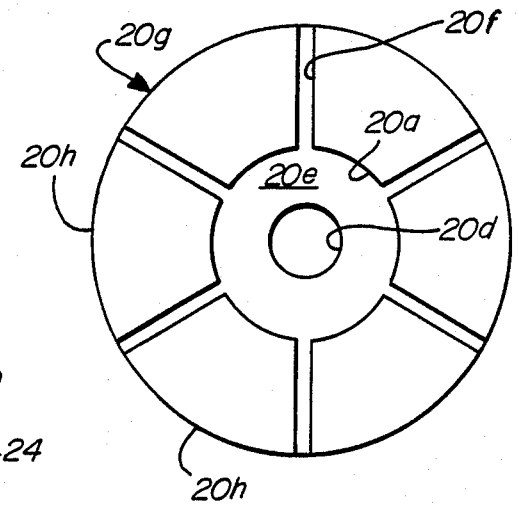
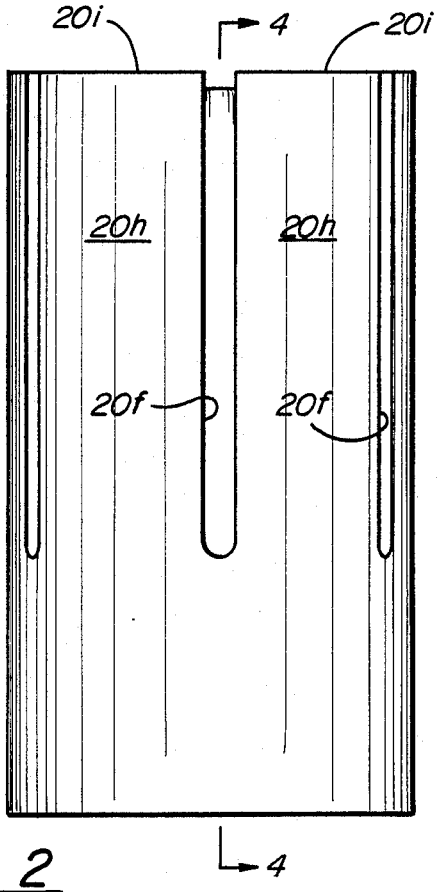
FIG. 2
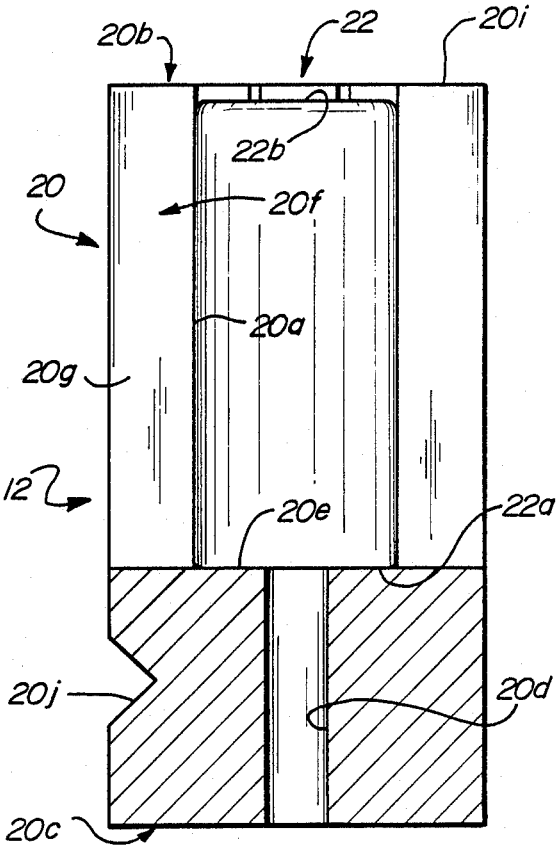
FIG. 4

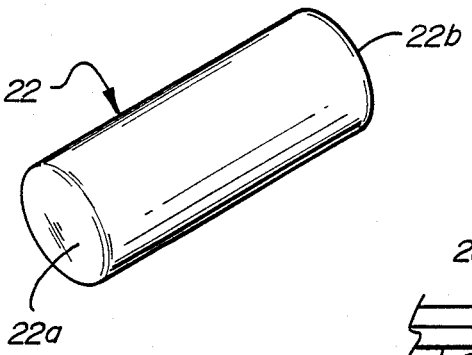
FIG. 5
FIG. 6
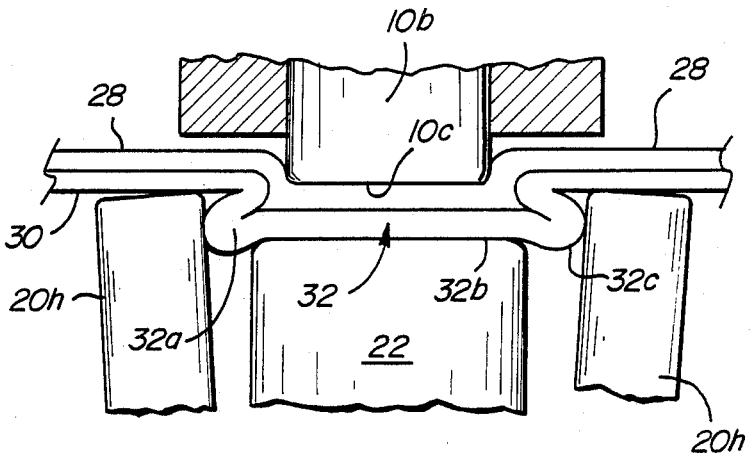
FIG. 7
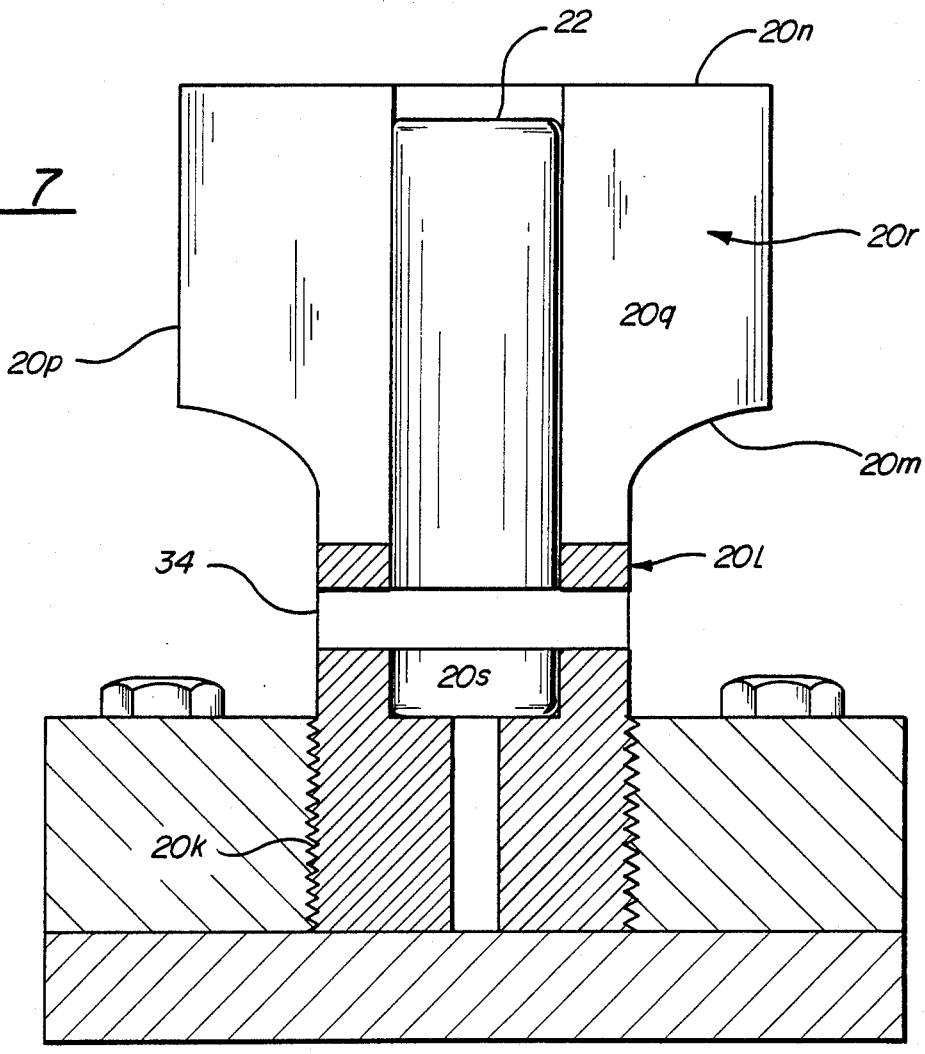

CLINCHING TOOL

RELATED APPLICATION

This application is a continuation-in-part of U.S. patent application Ser. 911,621, filed Aug. 29, 1986.

BACKGROUND OF THE INVENTION

This invention relates to tools for fastening two sheets of material together without welding or riveting and, more particularly, to a tool in which the sheets of material are fastened together in a clinching operation.

Sheets of material are most commonly fastened together by the use of welding or by the use of rivets. However, each of these methods has disadvantages. Specifically, welding entails high power requirements and large capital investments and cannot be used to fasten certain dissimilar materials, and riveting also requires high capital investment and produces a rather bulky joint that is unacceptable in many applications. In an effort to overcome the disadvantages of welding and riveting, clinching tools have been developed in which the sheets of material are deformed in a clinching operation to securely join these sheets together without the use of rivets and without the use of welds. Whereas these clinching tools have proven to be generally satisfactory in terms of producing a satisfactory joint as between the sheets of material, the available clinching tools are relatively expensive in original cost and are relatively difficult to repair so that a malfunction of the tool generally requires replacement of the entire tool. Existing clinching tools are also not readily modified to perform different kinds of clinching operations but rather are typically dedicated to a specific clinching operation involving specific materials and specific sheet thicknesses.

SUMMARY OF THE INVENTION

This invention is directed to the provision of a clinching tool which produces a superior clinching joint, is relatively inexpensive to initially manufacture, can be readily modified to adapt to differing applications, and can be readily repaired without necessity to replace the entire tool.

The clinching tool of the invention comprises a punch adapted to be mounted in a punch retainer and a die assembly coacting with the punch. The die assembly includes a tubular collet member and a pin member. The collet member is adapted to be mounted at its lower end in a die retainer in axial alignment with the axis of the punch and includes means defining a central axial pin bore in the collet opening at the upper end of the collet and extending downwardly to a location intermediate the upper and lower ends of the collet to form an annular collet wall surrounding the pin bore. The collet further includes means defining a transverse, upwardly facing seat at the lower end of the pin bore and further includes a plurality of circumferentially spaced axially extending slots formed in the annular collet wall and opening in the upper end of the collet to define a plurality of cantilevered collet fingers having their free ends at the upper end of the collet. The pin has a diameter approximating the diameter of the pin bore and a length slightly less than the length of the pin bore and is fitted in the pin bore with its lower end seated on the seat of the collet and with its upper ends faced slightly below the upper ends of the collet fingers. This arrangement allows the pin to be quickly and positively positioned relative to the collet member to provide ready assembly of the die assembly and to precisely position the free end of the pin member relative to the associated ends of the cantilevered fingers According to a further feature of the invention, the collet further includes a central axial knock out bore opening in the lower end of the collet and extending upwardly to a location proximate the lower end of the pin bore, and the knock out bore has a diameter substantially less than the diameter of the pin bore so as to form an annular shoulder at its juncture with the pin bore constituting the transverse upwardly facing seat in the collet. This arrangement provides a convenient and effective means of providing the bottom seat for the pin and for further providing a convenient means of dislodging the pin from the collar.

According to a further feature of the invention, the slots extend downwardly in the annular collet wall to the lower end of the pin bore so that the lower ends of the slots are generally co-planar with the annular shoulder defined at the juncture of the pin bore and the knock out bore. This arrangement allows the collet fingers to readily flex during the clinching operation to provide the desired material flow around the upper end of the pin of the die assembly.

BRIEF DESCRIPTION OF THE DRAWINGS

FIG. 1 is a somewhat schematic side elevational cross-sectional view of a clinching tool according to the invention;

FIG. 2 is side elevational view of a collet employed in the clinching tool of FIG. 1;

FIG. 3 is a top view of the collet of FIG. 2 with the pin member omitted for clarity;

FIG. 4 is a cross-sectional view taken on line 4—4 of FIG. 2;

FIG. 5 is a perspective view of the pin member employed in the clinching tool of FIG. 1;

FIG. 6 is a detail view on an enlarged scale showing the material flow occurring during the clinching operation performed by the clinching tool of FIG. 1; and FIG. 7 is a cross-sectional view showing a modified form of die assembly for use in the invention clinching tool.

DETAILED DESCRIPTION OF THE PREFERRED EMBODIMENT

The invention clinching tool includes a punch 10 and a die assembly 12.

Punch 10 includes a base portion **10*a* suitably held in a punch retainer 14, and a tip portion 10*b*. A stripper 16 is slidably mounted on tip portion 10b and urged downwardly by a compression spring 18**.

Die assembly 12 is positioned beneath punch 10 in coaxial alignment with the central axis of the punch and includes a collet or collar 20, a pin 22, a retainer 24, and a backing plate 26.

Collet 20 is formed of a suitable chromium-molybdenum steel, such for example as SAES6. Collet 20 is fabricated from bar stock and includes a central axial pin bore **20*a* opening at the upper end 20*b* of the collet and extending downwardly to a location intermediate the upper and lower ends of the collet. Collet 20 further includes a central axial knock out bore 20*d* opening in the lower end 20*c* of the collet and extending upwardly to a location proximate the lower end of pin bore 20*a* where it coacts with pin bore 20*a*** to form an annular shoulder 20*e* defining an annular seat. Collet 20 further includes a plurality of circumferentially spaced axially extending slots 20*f* formed in the annular collet wall 20*g* surrounding the pin bore 20*a* and opening in the upper end 20*b* of the collet to define a plurality of cantilevered collet fingers 20*h* having their free ends at the upper end of the collet. Slots 20*f* extend from annular shoulder 20*e* upwardly to the upper end of the collet so that the lower ends of the slots are generally co-planar with annular shoulder 20*e*.

Pin 22 is formed of a suitable chromium-molybdenum steel such, for example, as SAEA2. Pin 22 is circular in cross section and has a diameter approximating the diameter of pin bore 20*a* and a length slightly less than the length of pin bore 20*a* so that, when the pin is fitted in bore 20*a*, the lower end 22*a* of the pin is seated on annular shoulder 20*e* and the upper end 22*b* of the pin is spaced slightly below the upper ends 20*i* of the collet fingers 20*h*. It is desirable that the diameter of pin 22 slightly exceed the diameter of pin bore 20*a* so as to provide an interference fit therebetween. For example, the pin may be provided with a diameter 0.001 inches greater than the diameter of pin bore 20*a* so as to be retained snugly within cantilevered fingers 20*h*. It will be understood that the pin may be dislodged from bore 20*a* by upward insertion of a suitable knock out tool into knock out bore 20*d*.

The assembled relation of the parts of the die assembly is seen in FIG. 1. Specifically, lower end 20*c* of collet 20 is suitably mounted in a suitable aperture 24*a* in die retainer 24 with the lower end of the collet seated on a hardened backing plate 26 and with the retainer 24 and backing plate 26 suitably secured to a support member 28 by bolts 30. A set screw 32 threadably positioned in a threaded bore 24*a* in retainer 24 engages a notch 20*j* in the lower portion of collet 20 to lock the collet within the retainer 24. The various axial dimensions of the parts are selected such that the free or upper end 20*b* of pin 22 is inset with respect to the upper ends 20*i* of cantilever fingers 20*h* by a distance related to the thickness of the sheet materials 28 and 30 to be joined by the clinching tool.

The operation of the invention clinching tool is seen generally in FIG. 1 and in more detail in FIG. 6. As punch 10 is lowered by punch retainer 14 along the central axis of the clinching tool, the free or lower end 10*c* of punch tip portion 1O*b* contacts upper sheet 28 and, with continued downward movement, causes the adjacent material of sheets 28 and 30 to flow into the recess defined between the tip 22*b* of pin 22 and the upper ends 20*i* of cantilever fingers 20*h*. This flowing movement, filling the inset defined by the pin, is seen in FIG. 1. As the punch continues downwardly, and as best seen in FIG. 6, cantilever fingers 20*h* move radially outwardly relative to the central axis of the clinching tool to allow the adjacent material of sheets 28 and 30 to flow radially outwardly into the annular space defined by the retreating cantilever finger. The radially outwardly flowing material also tends to flow downwardly around the sides of pin 22.

Punch 10 is programmed to move downwardly relatively to pin 22 until it reaches a position in which punch lower end 10*c* is spaced from pin upper end 22*b* by a distance that is a major fraction of the combined initial thicknesses of sheets 28 and 30. For example, if sheets 28 and 30 have an initial combined thickness of 0.070 inches, the stop or final distance between punch lower end 10*c* and pin upper end 22*b* may be 0.04 inches. The joint 32 formed by the invention clinching tool includes an annular bead 32*a* which is clinched or folded back up against the under surface of sheet 30 through a full 180° so as to be tightly pressed against the under surface of sheet 30. Bead 32*a* is also extruded somewhat around the side surfaces of pin 22 so as to extend below the surface of the main body portion 32*b* of the joint to form a lip or coinage 32*c*. After the joint has been formed, punch 10 is moved upwardly and the joined sheets 28 and 30 are separated from the lower end of the punch by the action of stripper 16. The joint formed by the invention clinching tool rigidly joins the sheets 28 and 30 together; has a lower profile by virtue of the total folding of the lip 32*a* back up against the under surface of lower sheet 30; has an aesthetically pleasing appearance; and is leak-proof since neither the material of upper sheet 28 nor the material of lower sheet 30 has been cut through in the clinching process. The joint formed by the invention clinching tool is particularly suited for joining relatively thin sheet material and may typically replace a weld joint.

The modified die assembly seen in FIG. 7 is generally similar to the die assembly seen in FIGS. 16 with the exception that the lower end 20*k* of the collet is threaded and is threadably received in die retainer 24; a pin 34 extends transversely through collet side walls 24*l* to preclude inadvertent dislodgment of pin 22 from bore 24*q* in applications where the die assembly is positioned above the punch; and the side walls 24*l* are stepped at 24*m* to provide a relatively large composite annular area 24*n* at the tops of cantilevered fingers 24*p* and thereby minimize the marking that might otherwise occur in the sheets of material adjacent the upper ends of the fingers. It will be seen in this embodiment that slots 20*r* do not extend all the way down to the annular shoulder 20*s* but rather terminate above shoulder 20*s* to allow pin 34 to pass through the portion of the collet below slots 20*r*.

The invention clinching tool, by virtue of its extreme simplicity, may be manufactured at very low cost as compared to prior art clinching tools and lends itself to ready repair in the event of failure of one or more of its components. Specifically, whereas prior art clinching tools are generally of the throw-away variety requiring total replacement of the die assembly in the event of failure of one of the components of the die assembly, the components of the die assembly of the invention clinching tool may be individually and readily replaced in the event of component failure. Specifically, the collet and pin components of the die assembly may be quickly, individually and inexpensively replaced in the event of component wear or failure. Further, by virtue of the simple modular design of the die assembly of the invention clinching tool, the clinching tool may be readily adapted for widely varying applications involving widely varying sizes and types of sheet material simply by replacing one or more of the components with components especially tailored to the parameters of the particular application in question.

Whereas a preferred embodiment of the invention has been illustrated and described in detail, it will be apparent that various changes will be made in the disclosed embodiment without departing from the scope or spirit of the invention. For example, although the claims speak in terms of upper, lower, upwardly, downwardly, etc., it will be understood that these terms are only relative since the punch and die assembly may be used in various positions of relative orientation depending upon the particular clinching application envisioned.

We claim:

1. A clinching tool for fastening two sheet of material together, said tool comprising:

(A) a punch mounted in a punch retainer; and (B) a die including (1) a generally tubular one piece collet member mounted at its lower end in a die retainer in axial alignment with the axis of said punch, (2) means defining a central axial pin bore in said one piece collet member opening at the upper end of said collet member and extending downwardly to a location intermediate the upper and lower ends of said collet member to form an annular collet wall surrounding said pin bore and define a base portion at the lower end of said one piece collet member for mounting in the die retainer, (3) means defining a transverse, upwardly facing seat at the lower end of said pin bore, said seat facing the upper end of said collet member, (4) a plurality of circumferentially spaced axially extending slots formed in said annular collet wall and opening in the upper end of said collet member to define a plurality of cantilevered collet fingers extending integrally and upwardly from said base portion and having their free ends at the upper end of said one piece collet member, and (5) a pin, having a diameter approximating the diameter of said pin bore and a length slightly less than the length of said pin bore, fitted in said pin bore with its lower end solidly seated on said seat and with its upper end spaced slightly below the upper ends of said collet fingers, (C) said collet further includes a central axial knock out bore opening in the lower end of said collet and extending upwardly to a location proximate said lower end of said pin bore; and (D) said knock out bore has a diameter substantially less than the diameter of said pin bore so as to form an annular shoulder at its juncture with said pin bore constituting said transverse upwardly facing seat.

2. A clinching tool according to claim 1, wherein:

(E) said slots extend downwardly in said annular collet wall to the lower end of said pin bore so that the lower ends of said slots are generally coplanar with said annular shoulder.

3. A clinching tool for fastening two sheets of material together, said tool comprising:

(A) a generally tubular one piece collet member adapted to be mounted at its lower end in a die retainer in axial alignment with the axis of an associated punch;

(B) means defining a central axial pin bore in said one piece collet member opening at the upper end of said collet member and extending downwardly to a location intermediate the upper and lower ends of said collet member to from an annular collet wall surrounding said pin bore and define a base portion at the lower end of said one piece collet member for mounting in the die retainer, (C) means defining a transverse, upwardly facing seat at the lower end of said pin bore said seat facing the upper end of said collet member;

(D) a plurality of circumferentially spaced axially extending slots formed in said annular collet wall and opening in the upper end of said collet member to define a plurality of cantilevered collet fingers extending integrally and upwardly from said base portion and having their free ends at the upper end of said one piece collet member;

(E) a pin, having a diameter approximating the diameter of said pin bore and a length slightly less than the length of said pin bore, fitted in said pin bore with its lower end solidly seated on said seat and with its upper end spaced slightly below the upper ends of said collet fingers; said seat facing the upper end of said collet member.

4. A clinching tool according to claim 3, wherein:

(H) said slots extend downwardly in said annular collet wall to the lower end of said pin bore so that the lower ends of said slots are generally coplanar with said annular shoulder.

* * * * *